US006531091B2

(12) United States Patent
Miyamoto et al.

(10) Patent No.: US 6,531,091 B2
(45) Date of Patent: Mar. 11, 2003

(54) MUFFLER MADE OF A TITANIUM ALLOY

(75) Inventors: Yoshiyuki Miyamoto, Osaka (JP); Takashi Yashiki, Osaka (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 09/783,595

(22) Filed: Feb. 15, 2001

(65) Prior Publication Data

US 2002/0000268 A1 Jan. 3, 2002

(30) Foreign Application Priority Data

Feb. 16, 2000 (JP) ..... 2000-038427

(51) Int. Cl.[7] ..... C22C 14/00

(52) U.S. Cl. ..... 420/418; 181/213; 181/244; 181/282

(58) Field of Search ..... 420/418; 181/213, 181/244, 282

(56) References Cited

U.S. PATENT DOCUMENTS

| | | | | | |
|---|---|---|---|---|---|
| 2,554,031 | A | * | 5/1951 | Jaffee et al. | 75/134 |
| 2,575,962 | A | * | 11/1951 | Jaffee et al. | 75/134 |
| 2,596,485 | A | * | 5/1952 | Jaffee et al. | 75/134 |
| 2,622,023 | A | * | 12/1952 | Frazier | 75/177 |
| 2,666,698 | A | * | 1/1954 | Dickinson et al. | 75/177 |
| 2,703,278 | A | * | 3/1955 | Finlay et al. | 75/175.5 |
| 2,721,137 | A | * | 10/1955 | Pitler | 75/175.5 |
| 2,726,954 | A | * | 12/1955 | Jaffee et al. | 75/175.5 |
| 2,750,289 | A | * | 6/1956 | Jaffee et al. | 75/175.5 |
| 2,786,756 | A | * | 3/1957 | Swazy et al. | 75/175.5 |
| 2,798,806 | A | * | 7/1957 | Jaffee et al. | 75/175.5 |
| 2,810,642 | A | * | 10/1957 | Jaffee et al. | 75/175.5 |
| 2,821,475 | A | * | 1/1958 | Jaffee et al. | 75/175.5 |
| 3,049,425 | A | * | 8/1962 | Fentiman et al. | 75/175.5 |
| 3,378,368 | A | * | 4/1968 | Dudley et al. | 75/175.5 |
| 3,532,559 | A | * | 10/1970 | Fullotti | 148/11.5 |
| 3,619,184 | A | * | 11/1971 | Bomberger, Jr. | 75/175.5 |
| 4,064,963 | A | * | 12/1977 | Kaan et al. | 181/244 |
| 4,842,653 | A | * | 6/1989 | Wirth et al. | 148/12.7 B |
| 4,857,269 | A | * | 8/1989 | Wang et al. | 420/417 |
| 4,980,127 | A | * | 12/1990 | Parris et al. | 420/418 |
| 5,110,544 | A | * | 5/1992 | Sato et al. | 420/69 |
| 5,124,121 | A | * | 6/1992 | Ogawa et al. | 420/420 |
| 5,358,686 | A | * | 10/1994 | Parris et al. | 420/419 |
| 6,294,389 | B1 | * | 9/2001 | Vitale, Jr. et al. | 436/57 |

FOREIGN PATENT DOCUMENTS

| | | | |
|---|---|---|---|
| JP | 62-197611 | | 9/1987 |
| JP | 7-54084 | | 2/1995 |
| JP | 11182228 | * | 9/1999 |

OTHER PUBLICATIONS

Slim Fast with Titanium.(titanium mufflers produced by Arvin)(Brief Article), Author: Dale Jewett, Automotive Industries, 1999.*

* cited by examiner

*Primary Examiner*—Daniel J. Jenkins
(74) *Attorney, Agent, or Firm*—Oblon, Spivak, McClelland, Maier & Neustadt, P.C.

(57) ABSTRACT

A muffler of a muffler made of a titanium alloy wherein advantages of lightness and corrosion-resistance that the titanium alloy originally has are used, and heat-resistance and oxidization-resistance are heightened without damaging costs or workability so that the span of life and flexibility for design are improved. A muffler made of a titanium alloy, wherein the titanium alloy comprises 0.5–2.3% by mass of Al and optionally one or more other alloying elements. The metal texture may comprise more than 90% by volume of the α phase and 20% or less of the β phase. This muffler is superior in heat-resistance, oxidization-resistance, weldability and so on.

16 Claims, 5 Drawing Sheets

MUFFLER MADE OF A TITANIUM ALLOY

BACKGROUND OF THE INVENTION

1. Field of the Invention

The present invention relates to a muffler of a car or a motorbike, and in particular to a muffler made of a titanium alloy wherein advantages of lightness and corrosion-resistance that the titanium alloy originally has are used, and heat-resistance and oxidization-resistance are heightened without damaging costs or workability so that the span of life and flexibility for design are improved.

2. Description of Related Art

An exhaust system of a car or a motorbike is composed of an exhaust manifold, an exhaust pipe, a catalyst muffler, a pre-muffler, and a silencer (main muffler), which are, in this order, arranged from the exhaust gas outlet side of the engine. In the present specification, the generic term "muffler" is given to any one of these members or the whole thereof. As a constituent material of the muffler, ordinary steel was used in old times. In recent years, stainless steel superior in corrosion-resistance has been mainly used.

Concerning some fields, mainly the field of motorbikes, attention has been paid to a muffler made of Ti in more recent years. Cases in which each of standard grade motorbikes that are mass-produced, including motorbikes for a race, is equipped with a muffler made of Ti have been increasing since Ti, which is different from ordinary steel or stainless steel in the prior art, has the following characteristics 1)–4).

1) Ti has a specific gravity of about 60% of steel-type material. Thus, Ti is very light so that cars or motorbikes can be made light.
2) Ti has very good resistance against corrosive gas or corrosive liquid containing salt and exhaust components. Thus, problems about corrosion are wholly overcome. (Even stainless steel, which is generally said to have superior corrosion-resistance, undergoes corrosion based on salt scattered on the road surface to prevent freezing of the surface in winter.)
3) Since Ti is light, load stress based on vibration at the time of driving an engine is reduced. Thus, durable resistance against vibration fatigue is improved.
4) Ti has a smaller thermal expansion coefficient than steel. The thermal expansion coefficient is about 70% of that of ordinary steel, and about 50% of that of stainless steel. Therefore, stress load associated with thermal expansion is small. Thus, durable resistance against thermal fatigue is also superior.

In almost all of mufflers made of Ti which are made practicable at the present time, pure titanium of the JIS second grade, for industrial use, is used. It is predicted that the temperature of exhaust gas from cars or motorbikes is usually about 700° C. or higher. However, in the case that the outer surface of a muffler is large and is open to the air outside, as in motorbikes, heat radiates from the surface to the open air. Thus, the temperature of the muffler itself does not rise very much. Even the pure titanium of the JIS second grade can be used without any trouble. However, the temperature of metal positioned in an exhaust pipe in car mufflers, which is not directly open to the air, or metal positioned at a part where exhaust pipes joint in mufflers for motorbikes rises easily to a high temperature. Therefore, a Ti alloy having a higher heat-resistance than the JIS second pure titanium is desired. In the case that a Ti alloy having high heat-resistance and high strength is used, the Ti alloy positioned in sites whose temperature rises within a cold temperature range (a low temperature range of room temperature to about 400° C.) can also be made thin. Accordingly, it can be expected that the muffler can be made still lighter than JIS second grade pure titanium and the flexibility of design can be improved.

From such viewpoints, it can be considered that Ti alloys such as Ti-3Al-2.5V and Ti-6Al-4V, among existing titanium alloys, are hopeful materials for mufflers. However, for forming and fabrication into a muffler, a raw material needs to be made thin and must have superior workability. The above-mentioned two existing Ti alloys, which are insufficient in forming-workability, cannot satisfy the requirements.

Specifically, the above-mentioned Ti-6Al-4V is unsuitable for a material for mufflers such as an exhaust pipe and a silencer since this alloy cannot be worked into a thin plate by cold rolling. On the other hand, Ti-3Al-2.5V can be considered as the most hopeful material for mufflers among existing titanium alloys since this alloy can be cold-rolled to some extent and worked into a thin plate. In this titanium alloy, however, a border crack or an internal defect is easily generated in a cold rolling step. Thus, it is necessary that rolling and intermediate annealing are repeated plural times. As a result, costs for working to a thin plate are very high. Moreover, this alloy is far poorer in workability at the time of secondary working to a muffler than JIS second grade pure Ti materials.

SUMMARY OF THE INVENTION

In light of the above-mentioned situations, the present invention has been made. An object of the present invention is to provide a muffler superior in heat-resistance and oxidation-resistance, using a Ti alloy having the following performances.

1) The Ti alloy has better heat-resistance and oxidation-resistance than JIS second grade pure Ti materials, and can be applied to high temperature sites of a muffler.
2) Cold workability, which is insufficient in conventional Ti alloys having superior heat-resistance (Ti-3Al-2.5V and Ti-6Al-4V), is improved. Cold workability to a thin plate and workability to a muffler are made as high as JIS second pure Ti materials.
3) The Ti alloy is an alloy that can keep superior weldability since joint based on welding is essential in working to a muffler.

The muffler, made of a titanium alloy, of present invention that has attained the above-mentioned object is a muffler made of a titanium alloy, wherein the titanium alloy comprises 0.5–2.3% by mass of Al. By using this titanium alloy, it is possible to keep heat-resistance and oxidation-resistance required for a muffler and improve forming-workability. Therefore, a muffler that is suitable for production for working into a tube form and is thinner and lighter can be realized by curving a cold-rolled plate of the present titanium alloy and then subjecting the plate to seam welding.

Preferably, the titanium alloy is a binary-element alloy comprising Ti-(0.5–2.3%)Al. Any alloying element other than Al may be incorporated so far as the feature of the present invention is not lost. In this case, in order to keep heat-resistance and oxidation-resistance and improve workability sufficiently, it is preferred that the ratio of the $\alpha$ phase in metal texture of the titanium alloy is over 90% or more by volume.

The "muffler" referred to in the present invention is a generic term given to any one member of an exhaust manifold, an exhaust pipe, a catalyst muffler, a pre-muffler, a silence (main muffler) and the like, or the whole thereof. In other words, the "muffler" in the present invention means whole or a part of an exhaust system. The "muffler" in the present invention can be applied not only to a car or a motorbike but also to a ship or other machinery.

DETAILED DESCRIPTION OF THE PREFERRED EMBODIMENTS

In order to attain the above-mentioned object, the inventors made research, paying attention to Al, which is an alloying element giving heat-resistance improving effect to titanium materials. It is well known that Al is an alloying element effective for improving heat-resistance of titanium materials. However, by the inventors' experiments, it has been found out that as a larger amount of Al is added as an alloying element to Ti, some properties of the resultant alloy, in particular rolling ability, become lower.

Figure 1:
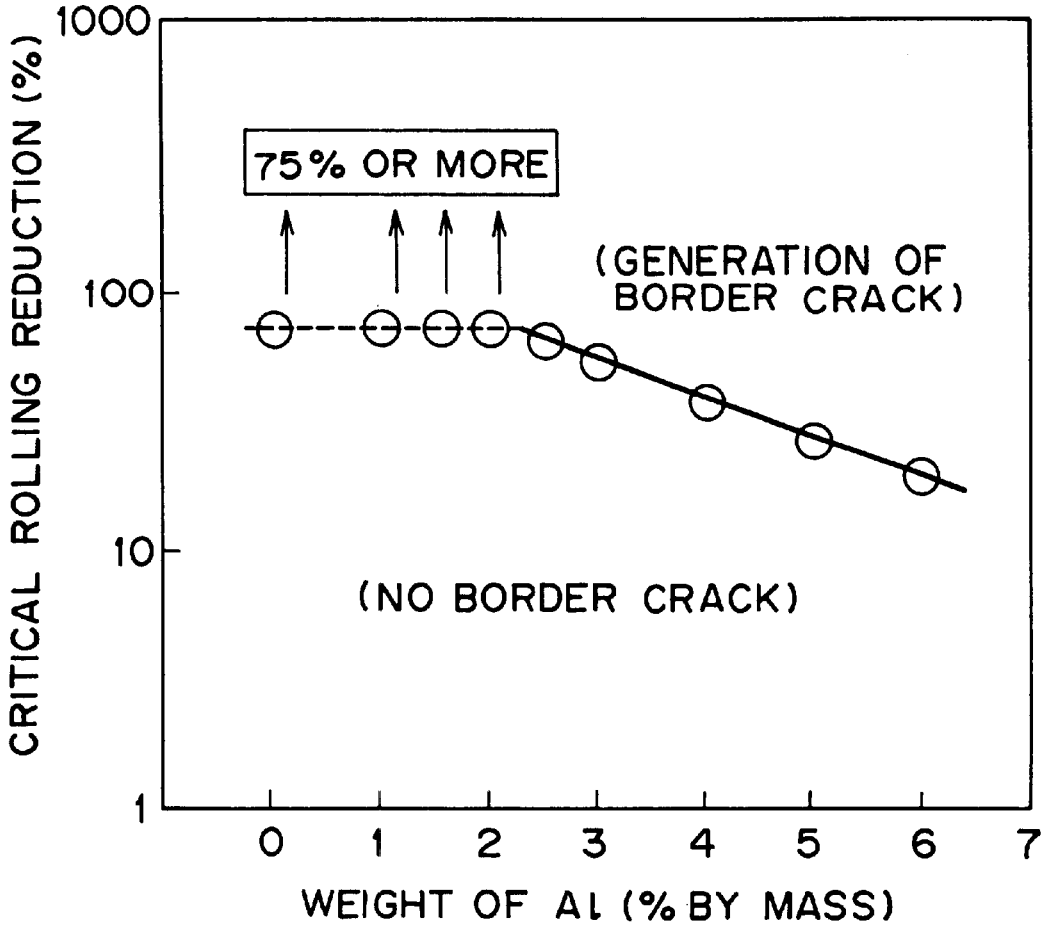
FIG. 1 is a graph showing the relationship between the amount of Al added to Ti and the critical rolling reduction of the resultant alloy in cold rolling.

FIG. 1 shows the effect of the Al content by percentage in binary-element alloy Ti—Al on cold rolling ability, and is a graph showing results of its critical rolling reduction until a border crack is generated in cold rolling. As is evident from this graph, in the range where the Al content by percentage is from 2 to 2.3%, no border crack is generated even if cold rolling into 75% is conducted. (The content by percentage means % by mass. The same rule is applied correspondingly to the following.) Thus, sufficient rolling ability is secured. However, when the Al content by percentage is over 2.3%, the critical rolling reduction is clearly reduced. When the Al content by percentage is over 5%, not only border cracks but also cracks throughout the plate are generated. If the Ti—Al alloy can keep a cold working ratio of 75%, the alloy can be worked to a thin plate by the same process as for JIS second grade pure titanium, which are widely used for mufflers at the present time. Thus, a substantial rise in production costs can be avoided. From the viewpoint of workability, it is essential that the Al content by percentage is set to 2.3% or less.

Figure 2:
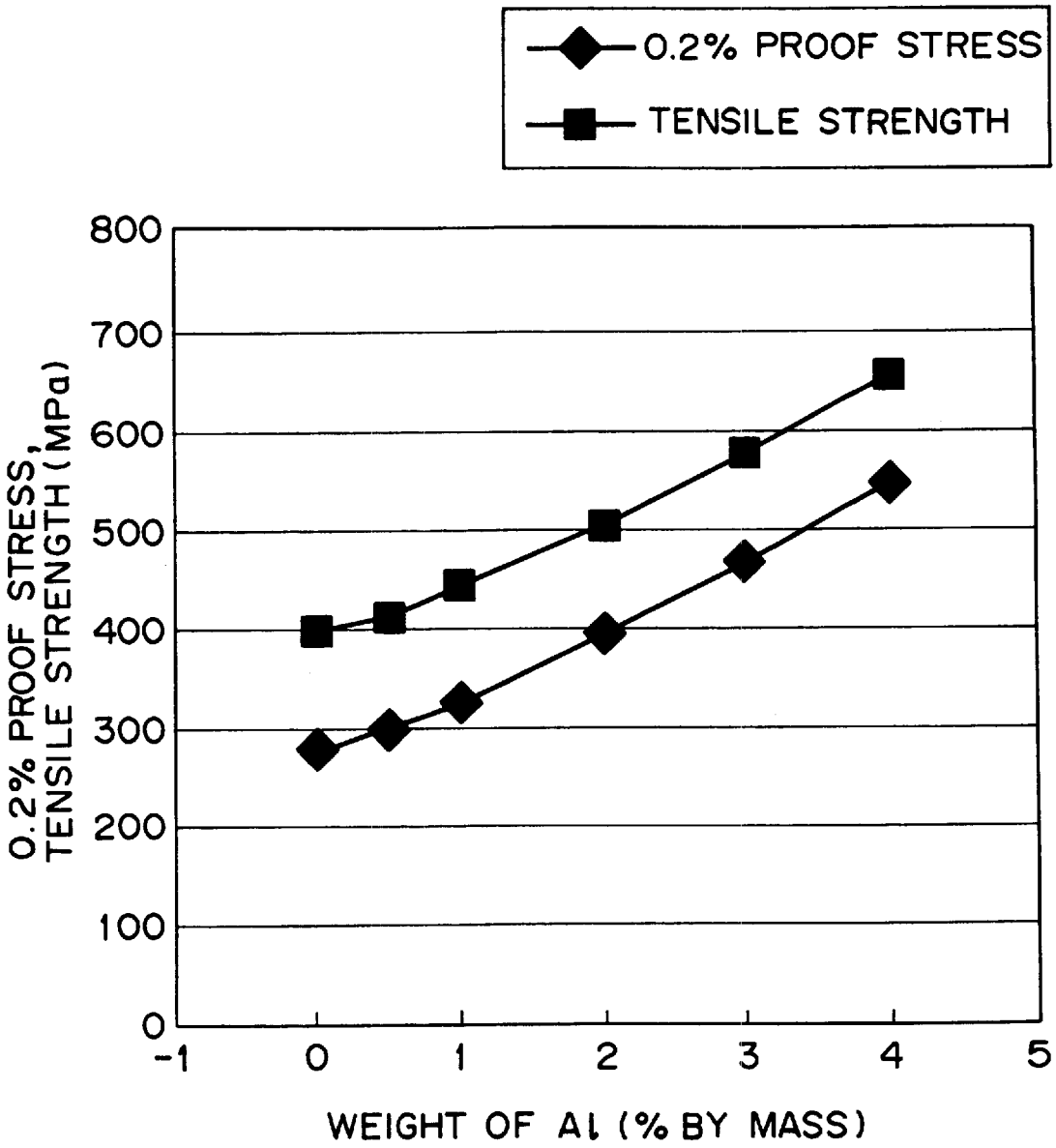
FIG. 2 is a graph showing the effect of the amount of Al added to Ti on the 0.2% proof stress and the tensile strength of the resultant alloy at room temperature.

Furthermore, in order to check the effect of the Al content by percentage on the tensile strength of titanium alloy, a tensile test was conducted at room temperature about titanium alloy wherein 0.5–4% of Al was added to a JIS second grade pure titanium material and titanium alloy wherein 0.5–4% of Al was added to Ti to examine the effect of the Al content by percentage on 0.2% proof stress and tensile strength thereof. The results are as shown in FIG. 2. It can be understood that with an increase in the Al content by percentage, the strength at room temperature increases substantially proportionally.

Figure 3:
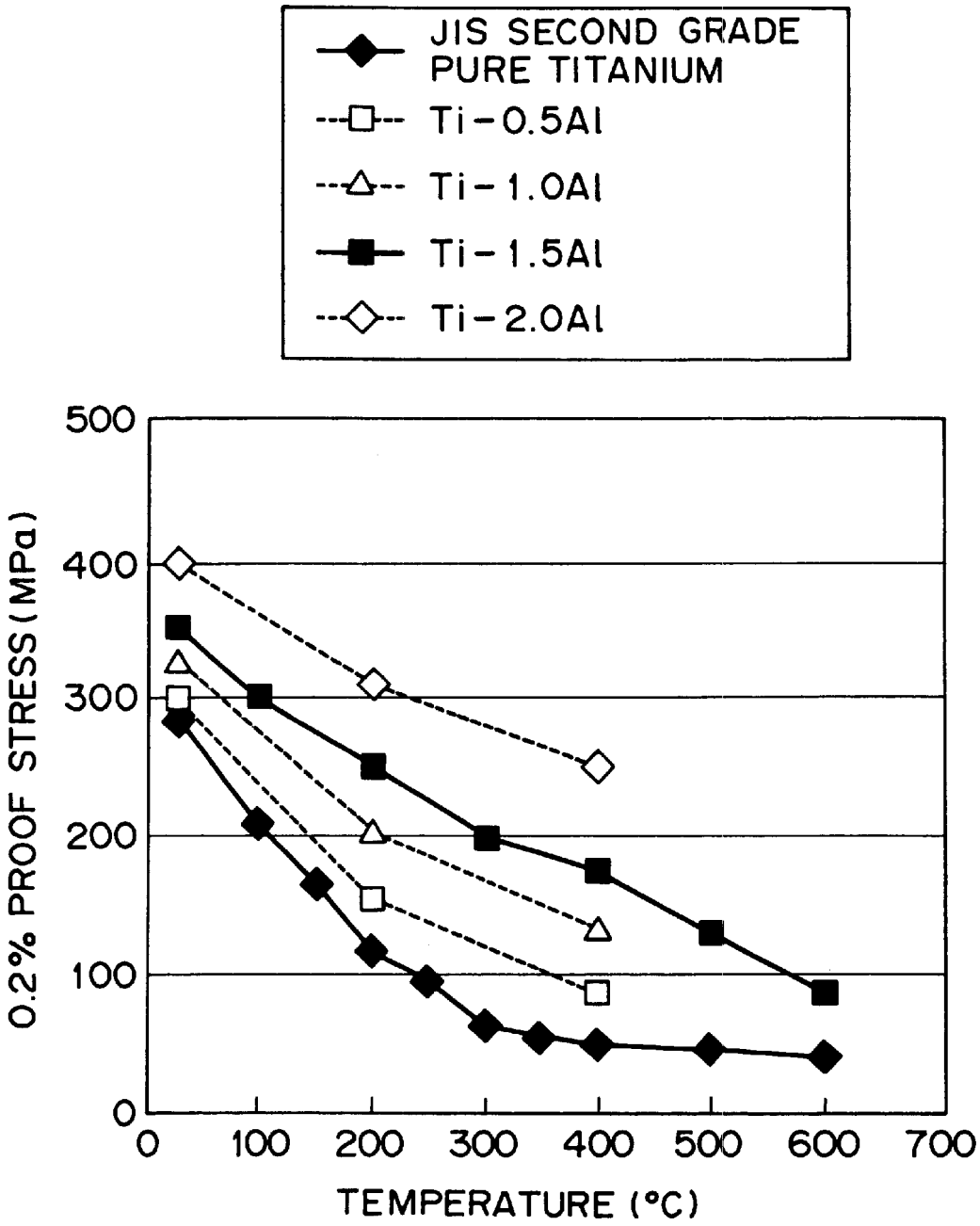
FIG. 3 is a graph showing comparison of changes in 0.2% proof stress of pure titanium alloy and in that of Ti—Al alloys, dependently on change in temperature.
Figure 4:
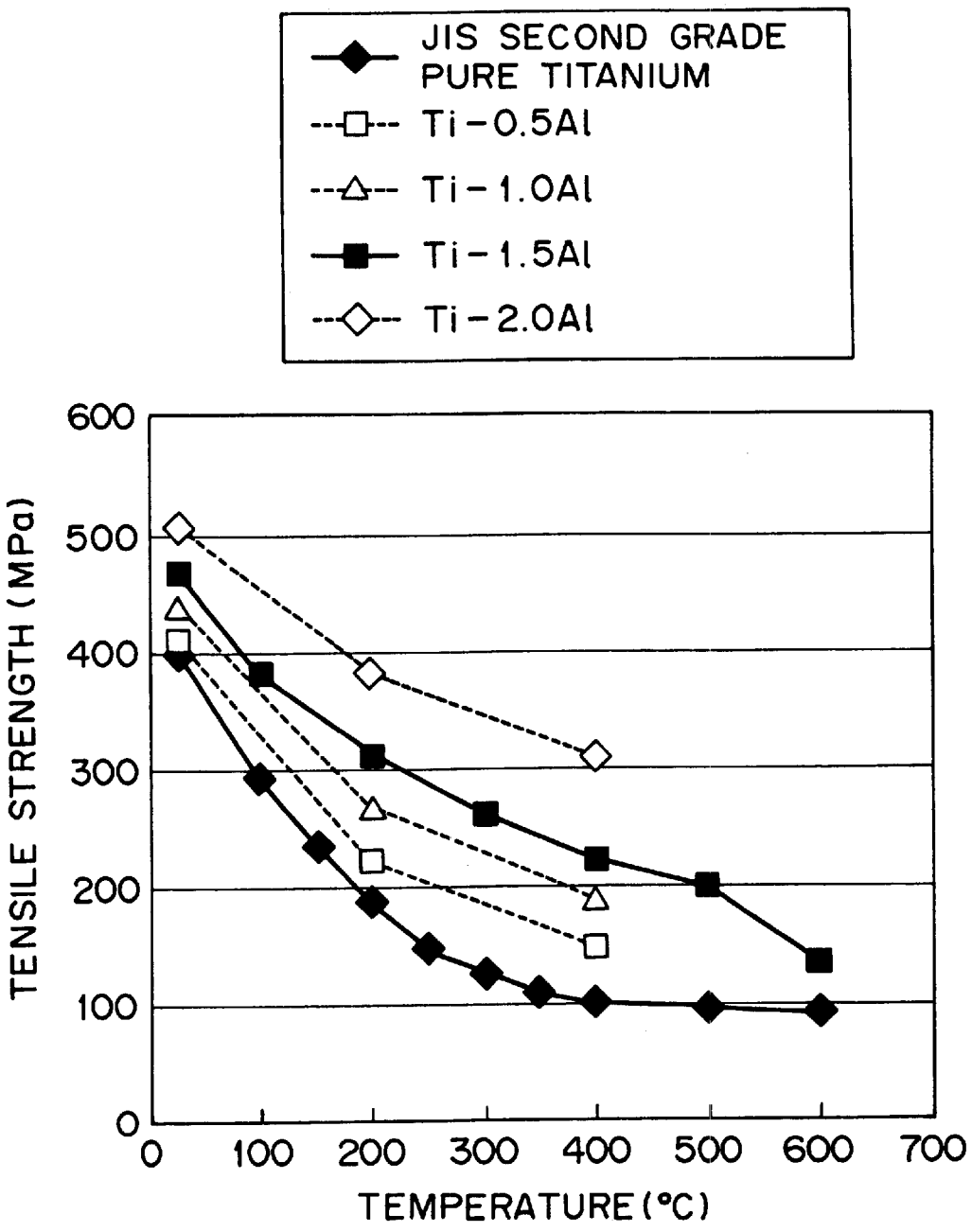
FIG. 4 is a graph showing comparison of changes in tensile strength of pure titanium alloy and in that of Ti—Al alloys, dependently on change in temperature.

In order to check the effect of addition of Al on heat-resistance, the relationship between temperature and 0.2% proof stress and the relationship between temperature and tensile strength were examined about JIS second grade pure titanium and Ti—Al alloys having different Al contents by percentage. The results are shown by FIGS. 3 and 4, respectively.

As is evident from these graphs, the strength of pure titanium drops remarkably in the range of cold temperatures. The strength at about 200° C. drops to half of the strength at room temperature. If temperature is over 300° C., the strength drops more remarkably. On the other hand, about the Ti—Al alloys, the drop in their strength accompanying the rise in temperature cannot be avoided, but the drop tendency thereof is smaller than pure titanium. As the Al content by percentage is made larger, the absolute value of the strength and the drop tendency thereof are smaller. Particularly about the alloy whose Al content by percentage is made high to 1.0% or more, even at about 500° C. the alloy keeps half of the strength at room temperature. Particularly in the cold temperature range of 200 to 500° C., the Ti—Al alloy exhibits strength 2–3 times that of pure titanium. It can be verified that the effect of improving the strength at high temperature by the addition of Al can be effectively exhibited by setting the Al content by percentage, preferably to 0.5% or more, and more preferably to 1.0% or more.

On the basis of the results of these experiments, as the requirement for keeping heat-resistance particularly in the cold temperature range of 200 to 500° C., the Al content by percentage is defined as 0.5% or more. From the viewpoint of the heat-resistance, the lower limit of the Al content by percentage is more preferably 1.0% or more. It is known that if an appropriate amount of Al is added to titanium, the oxidization-resistance of the alloy is also improved. If 0.5% or more of Al is incorporated into Ti as described above, the effect of improving the oxidization-resistance is also effectively exhibited. This also contributes to an improvement in the aptitude as a muffler material. The upper limit of the Al content by percentage is defined as 2.3% from the viewpoint of forming-workability, as described above. The upper limit is more preferably 2.0%.

As described above, the present invention has a feature that 0.5–2.3% of Al is incorporated into Ti to keep forming-workability, heat-resistance and oxidization-resistance required for the material for mufflers. The alloy composition that is simplest and is also preferred in light of both costs of raw materials and mass-productivity is a binary-element titanium alloy comprising Ti-(0.5–2.3%)Al. So far as the feather of the present invention is not damaged, alloying elements other than Al may be incorporated. Alternatively, the other elements may be incorporated to improve the effects of the present invention further or improve other performances.

Specific examples of the other alloying elements include solid-solution strengthening elements exhibiting strength-improving effect in the range of room temperature to cold temperature, such as Mo, V, Cr, Fe, Sn and Zr; W, Ta, Nb and rare earth elements exhibiting heat-resistant strength improving effect in the range of cold temperature to hot temperature; and B and C, which have heat-resistance improving effect. It is allowable to use a multi-element alloy, that is, a three or more element alloy wherein one or more of these elements are incorporated in appropriate amounts.

Any alloy wherein a main alloying element is Al and the metal texture as a whole of the alloy containing the above-mentioned other alloying elements contains more than 90% by volume of the α phase, which is a basic structure of Ti—Al alloy containing Al in an amount within the above-defined range, among the above-mentioned multi-element alloys, can sufficiently keep forming-workability, weldability, heat-resistance and the oxidization-resistance, an improvement of which is intended in the present invention. Thus, so far as the metal texture contains more than 90% by volume of the α phase, the above-mentioned other elements can be added. The crystal structure of pure titanium is the α phase. Since Al functions as an element for stabilizing the α phase, all of Ti—Al binary-element alloys are substantially alloys composed of the α phase. Elements such as Mo, V, Cr and Fe are elements for stabilizing the β phase. When the content by percentage of these elements increases, the amount of the β phase increases. Bad effects are produced on, in particular, heat-resistance and weldability. It is therefore unnecessary to define the upper limit of the content itself by percentage of these elements, but it is necessary to suppress the content within the range that can keep the metal texture in which the β phase is below 10% by volume, that is, the metal texture in which the effect of these elements is hardly produced.

The titanium alloy used in the muffler of the present invention has cold rolling ability, forming-workability and weldability equivalent to those of conventional pure titanium, as described above. It is therefore sufficient to adopt, as the method for producing the muffler of the invention, a method in accordance with that for producing a muffler from pure titanium. It is in general possible to adopt a method of blending ingredients to give a given alloy composition; melting and casting the composition in an ordinary way to prepare an ingot; subjecting the ingot to forging, hot rolling, annealing, removal of scale from the surface, cold rolling up to a given thickness and annealing; curving the resultant thin plate; seam-welding the curved plate into a tubular form; and forming the tube into a muffler form. Hot rolling conditions, cold rolling conditions, annealing conditions, seam welding conditions and so on in this production process should be appropriately adjusted dependently on the composition of the used titanium alloy, and so on.

EXAMPLES

The present invention will be specifically described by way of Examples. The present invention is not however limited to the following Examples and may be appropriately modified within the scope of the subject matter of the present invention. The modifications are included in the scope of the present invention.

Example (1) Production of Ti—Al Binary-element Alloy Thin Plates

Figure 5:
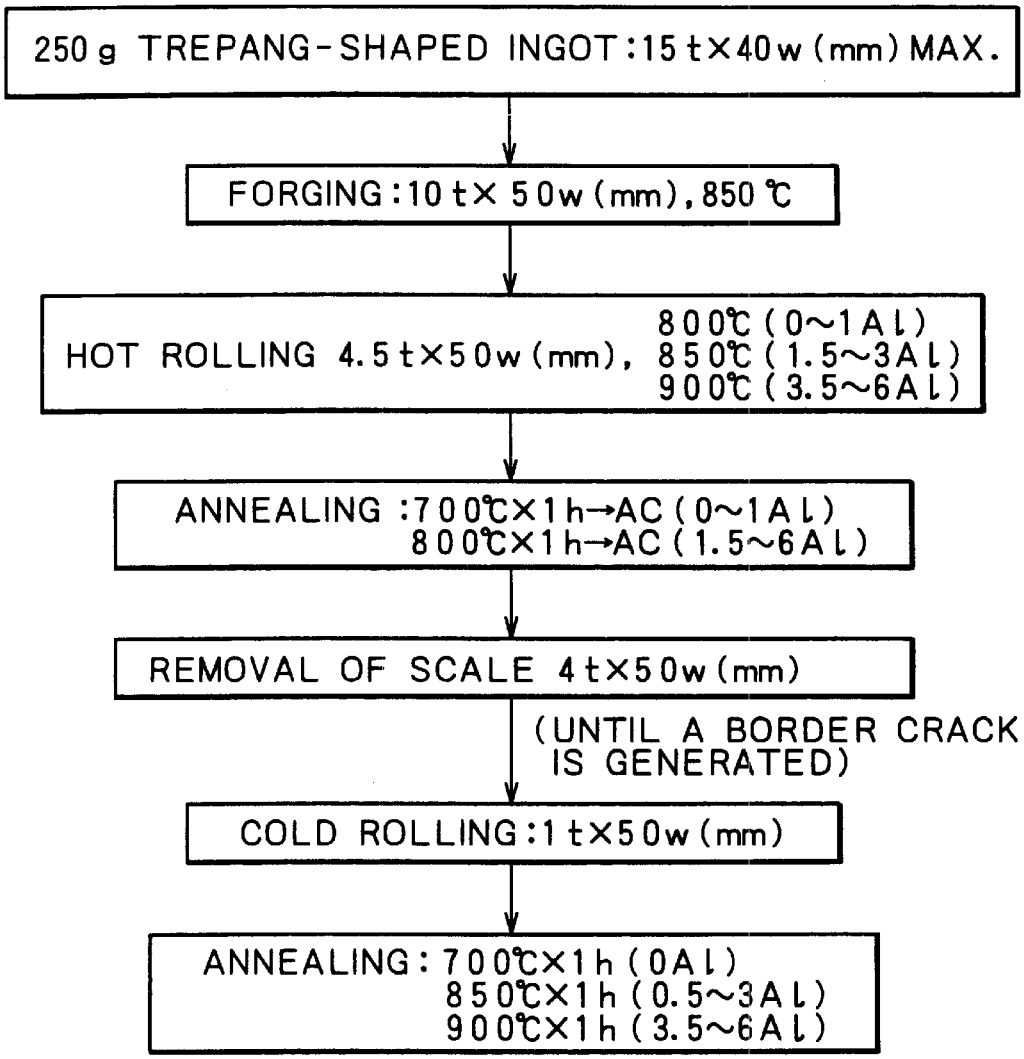
FIG. 5 is an explanatory view of a process for producing Ti—Al alloy thin plates, the process being adopted in experiments.

A vacuum arc melting furnace was used to prepare an ingot of pure titanium and ingots of Ti—Al alloys whose Al content by percentage was from 0 to 6%. The respective ingots had a weight of 250 g and were a trepang-shaped. The respective ingots were subjected to steps illustrated in FIG. 5 to work the ingots into thin plates 1 mm in thickness. By cold rolling, the thickness of the plates was made from 4 mm to 1 mm (rolling reduction: 75%) About the alloys wherein a border crack was generated in the middle way, the rolling was interrupted at the time of the generation. About the temperature of hot rolling performed before the cold rolling and the temperature of annealing steps, optimal conditions obtained in pre-experiments were adopted. The effect of the Al content by percentage on the critical rolling reduction of the alloys, which was obtained in this experiment, is shown in FIG. 1. A thin plate was also prepared from Ti-3Al-2.5V alloy, which is an existing alloy, in the same manner. In this alloy, an internal crack was generated at a cold rolling reduction of about 45%. A border crack was generated at a cold rolling reduction of 55%.

(2) Production of Ti-1.5Al Alloy Thin Plates

A thin plate was produced from a Ti-1.5Al alloy, which is a typical Al-added alloy. In the production, ingredients were melted by high-frequency wave scull melting and cast into an ingot 25 kg in weight. The ingot was subjected to forging, hot rolling, annealing, removal of scale, cold rolling and vacuum annealing, to prepare a coil having a plate thickness of 1 mm. In this case, conditions for the steps after the hot rolling were in accordance with the conditions shown in FIG. 5. This experiment demonstrated that the Ti-1.5Al alloy was also able to be worked into a thin plate in substantially the same process and conditions as for producing JIS second grade pure titanium.

Data on the Ti-1.5% Al alloy, shown in FIGS. 3 and 4, are results of a tensile test about the range of cold temperatures, using this coil as a specimen. As is evident from the results of Ti-1.5Al in FIGS. 3 and 4, the proof stress of this alloy was about 1.25 times that of JIS second grade titanium, which is a conventional Ti material for mufflers, and was 2.5–3.5 times in the cold temperature range of 300 to 500° C. It can be understood that if such a strength property is used, it is possible to make mufflers highly thin and light.

Data on Ti-0.5Ai, Ti-1.0Al, and Ti-2.0Al alloys, shown in FIGS. 3 and 4, are results of tensile tests at room temperature, 200° C., and 400° C., using the plates produced in the item (1).

(3) Production of a Ti-1.5Al Alloy Welded Tube

A strip 120 mm in width was cut out from the thin plate coil, and this strip was curved along its wide direction and then seam-welded to prepare a welded tube 1 mm in thickness and 38 mm in diameter. In the production of the tube, the following method was used since the coil was short: the method of welding a JIS second grade pure titanium strip as a dummy to the above-mentioned strip to stabilize the shape thereof by the pure titanium, and then seam-welding the Ti-1.5Al alloy portion continuously.

The curving workability and seam weldability at the time of obtaining the welded tube were entirely satisfactory, and the resultant seam-welded tube was able to be made wholesome under substantially the same conditions as for a pure titanium thin plate. Typical mechanical properties of the welded tube are as follows. The results demonstrate that the alloy in the present Example had sufficient properties for titanium alloy for mufflers.

① The welded tube was subjected to a tensile test, so that its 0.2% proof stress was 440 MPa and its tensile strength was 510 MPa. Its elongation percentage, which is concerned with forming-workability, was 35% and equivalent to that of pure titanium.

② A pushing-widening test was performed. In the test, a cone having a conical angle of 60 degrees was pushed on an end face of the welded tube to widen a concave. The resultant critical pushing-widening ratio was 1.4. This value is equivalent to that of a pure titanium welded tube. Deterioration in ductility was hardly generated in the welded portion.

③ The welded tube 38 mm in diameter was bent with a bend radius of 90 mm. As a result, defects such as cracks and wrinkles were not generated at all. Thus, it was demonstrated that this welded tube had a bending ability sufficient for forming the tube into an exhaust pipe or any one of other muffler members.

(4) Forming into a Muffler

A consumption electrode type arc melting furnace was used in the same manner as in an ingot production method adopted in mass-production of pure titanium thin plate coils, so as to produce one ton of an ingot made of Ti-2Al-1.3V alloy from 330 kg of scrap of Ti-6Al-4V alloy and 70 kg of sponge titanium. In accordance with an ordinary way, this ingot was subjected to cogging forging, hot rolling, annealing, removal of scale, cold rolling and vacuum annealing to produce a coil having plate thickness of 0.75 mm. This experiments demonstrated that the process for producing pure titanium was used as it was, so as to make it possible to work Ti-2Al-1.3V into a thin plate.

The resultant coil was used to produce welded tubes 38 mm and 50 mm in diameter. Moreover, a motorbike muffler was produced wherein the welded tube was used as a part of the outer cylinder and the interior of an exhaust pipe and a silencer pipe. In fabrication of the muffler, no problems were caused. This muffler was lighter by about 20% than a muffler having the same size and made of JIS second grade pure titanium. No troubles occurred in a practical vehicle test.

(5) Test for Checking Weldability of the Ti—Al Alloy

A test for checking weldability was performed using, as specimens, JIS second grade pure Ti, Ti-3Al-2.5V alloy, and Ti-6Al-4V alloy [thickness: 1 mm], each of which was mass-produced in a factory, and plate materials produced in the same manners as in the items (2) and (4) [thickness: 1 mm and 0.75 mm, respectively]. The respective specimens were metals in the state after the finishing annealing.

In this test, a bead [width: about 2 mm] penetrating, in the direction of the rolling, through each of the specimens from its front surface to its back surface was made by TIG welding, to form a sample similar to a weld joint. The resultant test sample was worked in the manner that a tensile direction was perpendicular to the bead, and then a weld joint tensile test was performed.

The results together with strength properties of its base material portion are shown in Table 1. Table 1 shows results of the amount (% by volume) of the phase in each of the specimens. The results were decided from X-ray diffracted strength. Since all of the alloys subjected to this test were a single phase alloys or ($\alpha$+$\beta$) two-phase alloys, the relationship that the amount (% by volume) of the $\beta$ phase was (100-the amount of the phase) was true.

TABLE 1

| Specimen | Position | Tensile strength (MPa) | Elongation (%) | Amount of the a phase (% by volume | Notes |
|---|---|---|---|---|---|
| JIS second pure Ti | Base material | 393 | 41 | 100 | Comparative Example |
| | Weld joint | 358 (0.99) | 40 (0.98) | | |
| Ti-1.5Al alloy | Base material | 446 | 33 | 100 | |
| | Weld joint | 420 (0.94) | 26 (0.79) | | Example |
| Ti-2Al-1.3V alloy | Base material | 550 | 25 | 95 | Example |
| | Weld joint | 535 (0.97) | 17 (0.68) | | |
| Ti-3Al-2.5V alloy | Base material | 693 | 19 | 90 | Comparative Example |
| | Weld joint | 692 (1.00) | 12 (0.63) | | |
| Ti-6Al-4V alloy | Base material | 958 | 15 | 84 | Comparative Example |
| | Weld joint | 1009 (1.05) | 6 (0.40) | | |

Values in parentheses are ratios (weld joint/base material).

As is evident from Table 1, with a decrease in the amount of the phase, the elongation percentages of the base material and the weld joint portion became lower. Particularly in the case that the amount of the phase was below 90% by volume, ductility was suddenly lowered.

(6) Examination of Oxidization-resistance of the Ti—Al Alloy

The plate made of the Ti—Al two-element alloy and produced in the item (1) was used to examine the oxidization-resistance thereof. The alloy was heated at 700° C. for 20 hours or 700° C. for 40 hours in the atmosphere. The resultant results are shown in Table 2. As is evident from this table, oxidization-resistance is improved by the addition of Al, and the present alloy is more preferred for a muffler material than conventional pure Ti

TABLE 2

| | Increase in oxide (mg/cm2) | |
|---|---|---|
| Specimen | 700° C. × 20 hours | 700° C. × 40 hours |
| JIS second grade pure Ti | 0.45 | 0.70 |
| Ti-1Al alloy | 0.34 | 0.51 |
| Ti-2Al alloy | 0.32 | 0.42 |
| Ti-3Al alloy | 0.31 | 0.38 |
| Ti-4Al alloy | 0.26 | 0.28 |

What is claimed is:

1. A muffler made of a material, wherein said material comprises a titanium alloy, wherein the titanium alloy comprises 0.5–2.3% by mass of Al.

2. The muffler according to claim 1, wherein the ratio of the $\alpha$ phase in metal texture of the titanium alloy is over 90% by volume.

3. A muffler made of a material, wherein said material comprises a titanium alloy, wherein the titanium alloy consists of 0.5–2.3% by mass of Al, and Ti and impurities as balance.

4. The muffler according to claim 1, which is produced by curving a cold-rolled plate made of the titanium alloy and then seam-welding the plate so as to be worked into a tube.

5. The muffler according to claim 2, which is produced by curving a cold-rolled plate made of the titanium alloy and then seam-welding the plate so as to be worked into a tube.

6. The muffler according to claim 3, which is produced by curving a cold-rolled plate made of the titanium alloy and then seam-welding the plate so as to be worked into a tube.

7. A muffler made of a material, wherein said material comprises a titanium alloy, wherein the titanium alloy consists essentially of 0.5–2.3% by mass of Al, and Ti and impurities as balance.

8. The muffler according to claim 1, wherein the titanium alloy additionally comprises at least one element selected from the group consisting of Mo, V, Cr, Fe, Sn, Zr, W, Ta, Nb, rare earth elements, B and C.

9. The muffler according to claim 2, wherein the titanium alloy additionally comprises at least one element selected from the group consisting of Mo, V, Cr, Fe, Sn, Zr, W, Ta, Nb, rare earth elements, B and C.

10. A muffler made of a material, wherein said material comprises a titanium alloy, wherein the titanium alloy consists of 0.5–2.3% by mass of Al, at least one element selected from the group consisting of Mo, V, Cr, Fe, Sn, Zr, W, Ta, Nb, rare earth elements, B and C, and Ti and impurities as balance.

11. The muffler according to claim 7, wherein the titanium alloy additionally comprises at least one element selected from the group consisting of Mo, V, Cr, Fe, Sn, Zr, W, Ta, Nb, rare earth elements, B and C.

12. The muffler according to claim 1, wherein the titanium alloy comprises at least 1% by mass of Al and not more than 2% by mass of Al.

13. The muffler according to claim 3, wherein the titanium alloy is Ti-0.5 Al.

14. The muffler according to claim 3, wherein the titanium alloy is Ti-1.0 Al.

15. The muffler according to claim 3, wherein the titanium alloy is Ti-i 1.5 Al.

16. The muffler according to claim 3, wherein the titanium alloy is Ti-2.0 Al.

* * * * *